United States Patent [19]

Metzger

[11] Patent Number: 4,906,204

[45] Date of Patent: Mar. 6, 1990

[54] ELECTRICAL CONNECTOR WITH CONNECTOR POSITION ASSURANCE DEVICE

[75] Inventor: John R. Metzger, Cortland, Ohio

[73] Assignee: General Motors Corporation, Detroit, Mich.

[21] Appl. No.: 223,339

[22] Filed: Jul. 25, 1988

[51] Int. Cl.[4] ..... H01R 13/627

[52] U.S. Cl. ..... 439/352; 439/353; 439/533; 439/550

[58] Field of Search ..... 439/347, 350, 351, 352, 439/353, 354, 355, 357, 358, 488, 489, 491

[56] References Cited

U.S. PATENT DOCUMENTS 4,370,013 1/1983 Niitsu et al. ..... 339/82
4,634,204 1/1987 Detter et al. ..... 339/91
4,708,413 11/1987 Schroeder ..... 439/358
4,746,306 5/1988 Yurtin et al. ..... 439/357

*Primary Examiner*—Neil Abrams
*Assistant Examiner*—Khiem Nguyen
*Attorney, Agent, or Firm*—F. J. Fodale

[57] ABSTRACT

An electrical connector comprises a male connector body having a rigid cantilevered lock arm which slides into a track portion of a female connector body. The female connector body as a flexible internal latch arm which has a lock projection which engages in a window of the rigid lock arm to lock the connector bodies together.

A connector position assurance device slides into a gauge slot of the female connector body only if the connector bodies are properly engaged and the internal flexible latch arm is fully engaged in the window of the rigid lock arm.

3 Claims, 2 Drawing Sheets

ELECTRICAL CONNECTOR WITH CONNECTOR POSITION ASSURANCE DEVICE

BACKGROUND OF THE INVENTION

This invention relates generally to electrical connectors and more specifically to electrical connectors which have a connector position assurance device to assure that mating connectors are properly mated and locked together.

Electrical connectors which have such devices are already known in the prior art.

U.S. Pat. No. 4,370,013 issued to Mitsugi Niitsu et al Jan. 25, 1983 shows a connector device for electric circuit comprising male and female connector housings which are locked together by a flexible tongue piece of one connector housing engaging a cross piece of the other connector housing. When the connector housing are fastened, an insertion piece is inserted below the cross piece between the flexible tongue piece and the connector housing of the cross piece to prevent disengagement of the flexible tongue piece from the cross piece.

U.S. Pat. No. 4,746,306 issued to John A. Yurtin et al May 24, 1988 shows an electrical connector comprising dielectric connector bodies which are coupled and locked together by a resilient lock member of one connector body which engages a lock member of the other connector body to form a gauge hole. The gauge hole receives a gauge pin if the connector bodies are properly mated and locked together.

U.S. Pat. No. 4,634,204 issued to Gary C. Detter et al June 6, 1987 shows an electrical connector comprising male and female connectors which are locked together by a flexible lock arm of one connector engaging a cross piece of the other connector. When the connectors are mated, a connector position assurance and assist device is inserted axially along a tracked slot beneath the flexible lock arm to assure proper mating and prevent disengagement of the flexible latch arm from the cross piece.

U.S. Pat. No. 4,708,413 issued to Diane M. Schroeder Nov. 24, 1987 shows a connector device for electric circuit comprising a pair of matable connector bodies locked together with a pump handle type of lock which is disabled by a connector position assurance device when the connector bodies are properly mated.

SUMMARY OF THE INVENTION

The object of this invention is to provide an electrical connector comprising mating connectors which have an improved and unique means for locking the mated connectors together and assuring that the connectors are properly mated and locked together so that electrical contact across the connection is established and maintained.

A feature of the invention is that the mated electrical connectors are locked together by a rigid lock arm of one connector and an internal flexible latch arm of the mating connector.

Another feature of the invention is that the internal flexible lock arm prevents even partial installation of a connector position assurance device if the electrical connectors are only partially mated and the internal flexible latch arm is not fully engaged.

Another feature of the invention is that the flexible latch arm is internally disposed so that it is fully protected by insulative body structure of the electrical connector of which it is a part.

Other objects and features of the invention will become apparent to those skilled in the art as disclosures is made in the following detailed description of a preferred embodiment of the invention which sets forth the best mode of the invention contemplated by the inventor and which is illustrated in the accompanying sheet(s) of drawing.

DETAILED DESCRIPTION OF THE PREFERRED EMBODIMENT

Figure 1:
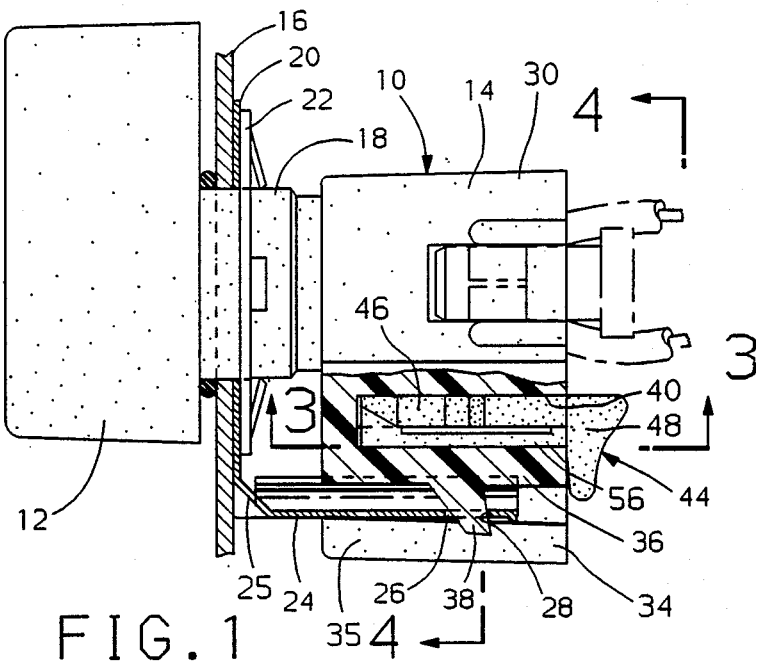
FIG. 1 is a partially sectioned elevation of an electrical connector having a lock means and connector position assurance device in accordance with this invention.
Figure 2:
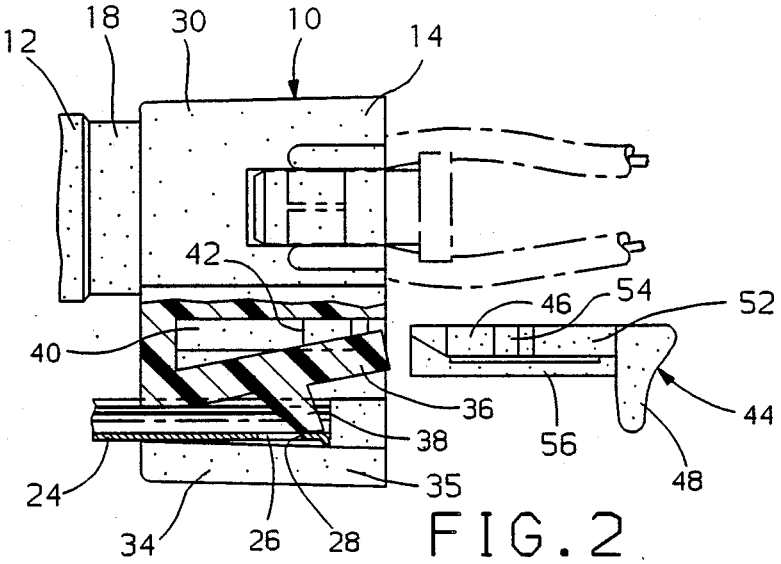
FIG. 2 is a fragmentary partially sectioned elevation of the electrical connector shown in FIG. 1 illustrating the connector position assurance device prior to installation.

Referring now to the drawings, the electrical connector 10 comprises a male connector body 12 and a female body 14. The male connector body 12 houses electrical male terminals (not shown). These electrical male terminals mate with electrical female terminals (not shown) which are housed in the female connector body 14 when the connector bodies are mated as shown in FIGS. 1 and 2.

The male connector body 12 is mounted on a panel 16 by inserting a mating portion 18 through an aperture through the panel 16. A metal clip 20 is mounted on the mating portion 18 which projects through the panel 16. The metal clip 20 is held against the panel 16 by a metal lock nut 22 which is pushed onto the mating portion 18 to retain the male connector body 12 in its mounted position on the panel 16.

Figure 4:
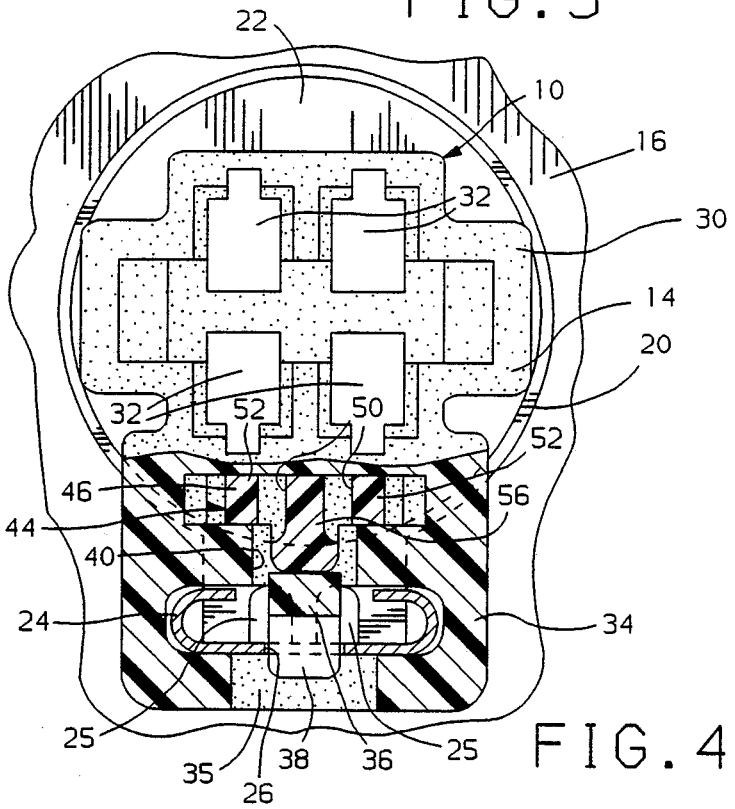
FIG. 4 is a section taken substantially along the line 4—4 of FIG. 1 looking in the direction of the arrows.

The metal clip 20 which is secured to the male connector body 12 by the metal lock nut 22 includes a cantilevered lock arm 24. The cantilevered lock arm 24 has gussets 25 at its attachment end for increased strength and a C-shaped cross-section as shown in FIG. 4 so that the lock arm 24 is substantially rigid. The lock arm 24 also has a window 26 at its free end which provides a lock edge or shoulder 28.

The female connector body 14 includes a terminal receiving portion 30 which has a plurality of terminal receiving cavities 32 for the electrical female terminals (not shown) which mate with the electrical male terminals of male connector body 12. The female connector body 14 also includes a track portion 34 which has a T-shaped slide slot 35 and an internal flexible latch arm 36 which has a lock projection 38. The internal flexible latch arm 36 and lock projection 38 are normally disposed in the T-shaped slide slot 35 and thus completely protected by the track portion 34.

The track portion 34 receives the rigid lock arm 24 of the male connector 12 and the window 26 of the rigid lock arm 24 in turn receives the lock projection 38 of the flexible latch arm 36 when the connector bodies 12 and 14 are properly mated and locked together as shown in FIGS. 1 and 4.

Figure 3:
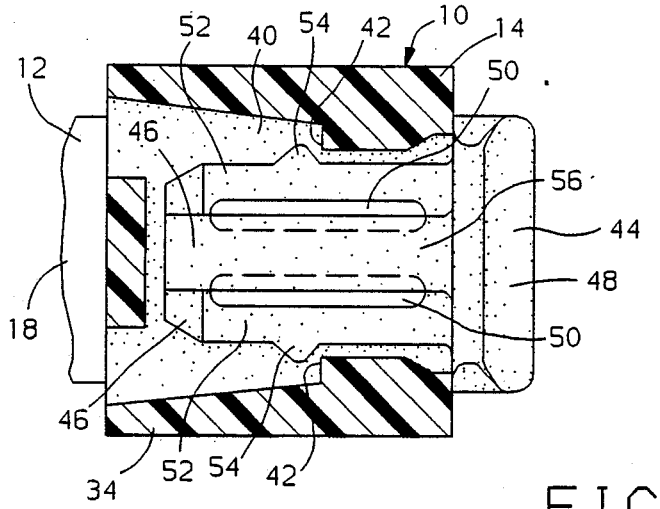
FIG. 3 is a section taken substantially along the line 3—3 of FIG. 1 looking in the direction of the arrows.

The female connector body 14 further includes a T-shaped gauge slot 40 which is located between the terminal receiving portion 30 and the track portion 34. The T-shaped gauge slot 40 has lock shoulders 42 in the side walls of its cross portion as shown in FIG. 3. The internal flexible latch arm 36 is at the bottom of the T-shaped gauge slot 40 so that the internal flexible latch arm 36 deflects into the gauge slot 40 during mating as shown in FIG. 2.

The electrical connector 10 further includes a connector position assurance device 44 which comprises a T-shaped body gauge 46 and a handle 48. The cross member of the T-shaped body gauge 46 has a pair of slots 50 to provide flexible side portions 52 which have lock nibs 54. The lock nibs 54 engage the lock shoulders 42 of the female connector body 14 to retain the T-shaped body 46 in the gauge slot 40 which in turn prevents disengagement of the flexible latch arm 36.

The upright portion 56 of the T-shaped body 46 is dimensioned so that it slides into the upright portion of the gauge slot 40 only if the connector bodies 12 and 14 are properly engaged and the flexible latch arm 36 is fully engaged in the window 26 of the rigid lock arm 24 as shown in FIG. 1. If the flexible latch arm 36 is not fully engaged, the presence of the flexible latch arm 36 in the gauge slot 40 prevents installation of the connector position assurance device 44 as shown in FIG. 2.

I wish it to be understood that I do not desire to be limited to the exact details of construction shown and described, for obvious modifications will occur to a person skilled in the art.

The embodiments of the invention in which an exclusive property or privilege is claimed are defined as follows:

1. An electrical connector comprising;

a first connector body and a second body which house mating electrical terminals when the connector bodies are mated, said first connector body having a cantilevered lock arm which includes a lock shoulder, said second connector body having a track portion which receives the lock arm of the male connector body and a flexible portion which is internally disposed and fully projected by the track portion, the flexible portion having a lock projection which engages the lock shoulder of the lock arm when the connector bodies are properly mated and locked together, said second connector body further including a gauge slot which is partially defined by the flexible portion, and a connector position assurance device which comprises a gauge body and a handle, said gauge body being dimensioned so that it is slideably received in the gauge slot only if the connector bodies are properly mated and the flexible portion is fully engaged.

2. An electrical connector comprising, a first connector body and a second connector body which house mating electrical terminals when the connector bodies are mated, said first connector body having a cantilevered lock arm which has a C-shaped cross-section so that the lock arm is substantially rigid and which has a window at its free end which provides a lock shoulder, said second connector body having a track portion which has a T-shaped slide slot and an internal flexible latch arm which has a lock projection, said internal flexible latch arm being normally disposed in the T-shaped slide slot so that the flexible latch arm is internally disposed and completely protected by the track portion of the second connector body, said track portion receiving the rigid lock arm of the first connector body which in turn receives the lock projection of the flexible latch arm when the connector bodies are properly mated and locked together, said second connector body further including a T-shaped gauge slot, said flexible latch arm being at the bottom of the T-shaped gauge slot and deflectable into the T-shaped gauge slot during connector mating, and a connector position assurance device which comprises a T-shaped gauge body and a handle, said T-shaped gauge body having a cross member which has a pair of slots to provide flexible side portions which have lock nibs which engage lock shoulders of the second connector body to retain the T-shaped gauge body in the gauge slot, and said T-shaped gauge body having an upright portion which is dimensioned so that it is slideably received in the upright portion of the gauge slot only if the connector bodies are properly engaged and the flexible latch arm is fully engaged in the window of the rigid lock arm.

3. An electrical connector comprising;

a first connector body and a second connector body which house mating electrical terminals when the connector bodies are mated, said first connector body having a cantilevered lock arm which is substantially rigid and which has a lock shoulder at its free end, said second connector body having a track portion which has a slide slot and an internal flexible latch arm which has a lock projection, said internal flexible latch arm being normally disposed in the slide slot so that the flexible latch arm is internally disposed and completely protected by the track portion of the second connector body, said track portion receiving the rigid lock of the first connector body which in turn receives the lock projection of the flexible latch arm when the connector bodies are properly mated and locked together, said second connector body further including a gauge slot which the flexible latch arm deflects into during connector mating, and a connector position assurance device which comprises a gauge body and a handle, said gauge body being dimensioned so that it is slideably received in the gauge slot only if the connector bodies are properly engaged and the flexible latch arm is fully engaged with the rigid lock arm and having means to retain the gauge body in the gauge slot.

* * * * *